US009243376B2

(12) United States Patent
Guggino et al.

(10) Patent No.: US 9,243,376 B2
(45) Date of Patent: Jan. 26, 2016

(54) SURFACE COMPLIANT FRONT-PIVOTING WEAR SHOES FOR SNOW PUSHER

(71) Applicant: Pro-Tech Manufacturing and Distribution, Inc., Rochester, NY (US)

(72) Inventors: Michael J. Guggino, Blomfield, NY (US); James Maier, Ontario, NY (US); Jerre Heyer, Erie, PA (US)

(73) Assignee: Pro-Tech Manufacturing and Distribution, Inc., Rochester, NY (US)

( * ) Notice: Subject to any disclaimer, the term of this patent is extended or adjusted under 35 U.S.C. 154(b) by 225 days.

(21) Appl. No.: 13/918,288

(22) Filed: Jun. 14, 2013

(65) Prior Publication Data

US 2014/0366406 A1 Dec. 18, 2014

(51) Int. Cl.
*E01H 5/06* (2006.01)

(52) U.S. Cl.
CPC ..... *E01H 5/066* (2013.01)

(58) Field of Classification Search
CPC ..... E01H 5/063; E01H 5/066; E01H 5/06; E01H 5/062; E01H 5/00; E01H 5/04; E01H 5/061
See application file for complete search history.

(56) References Cited

U.S. PATENT DOCUMENTS

| | | | | | |
|---|---|---|---|---|---|
| 520,479 | A | * | 5/1894 | Bunnell | 172/701.3 |
| 1,687,169 | A | | 10/1928 | Marran | |
| 1,887,451 | A | * | 11/1932 | Dombrowski | 37/270 |
| 1,904,201 | A | | 4/1933 | Chapman | |
| 1,957,103 | A | | 5/1934 | Frink | |
| 2,061,585 | A | | 11/1936 | Meyer | |
| 2,085,996 | A | | 7/1937 | Phillips | |
| 2,365,597 | A | | 12/1944 | Roth | |
| 2,403,219 | A | | 7/1946 | Hanson et al. | |
| 2,768,453 | A | * | 10/1956 | Adams, Jr. | 37/252 |
| 3,010,230 | A | | 11/1961 | Zubko | |
| 3,217,431 | A | | 11/1965 | Heinzroth et al. | |
| 3,320,688 | A | * | 5/1967 | Haban et al. | 37/242 |
| 3,604,131 | A | | 9/1971 | Bogenschutz et al. | |
| 4,255,878 | A | | 3/1981 | Mahler et al. | |
| 4,395,156 | A | * | 7/1983 | Sprague, III | 404/110 |
| 4,441,266 | A | * | 4/1984 | Westimayer | 37/244 |
| 4,707,936 | A | | 11/1987 | Steinhoff | |
| 4,962,600 | A | * | 10/1990 | Zellaha et al. | 37/280 |
| 5,058,294 | A | * | 10/1991 | Bryan, Jr. | 37/190 |
| 5,109,618 | A | | 5/1992 | Grubler et al. | |

(Continued)

FOREIGN PATENT DOCUMENTS

| | | |
|---|---|---|
| EP | 1557494 | 1/2004 |
| GB | 886572 | 1/1962 |

OTHER PUBLICATIONS

Bonnell Push 'N-Plow brochure; 5 pages; Bonnell Industries Inc., 1385 Franklin Grove Rd., Dixon, IL 61021; Fax Date May 3, 2002.

(Continued)

*Primary Examiner* — Thomas B Will
*Assistant Examiner* — Joan D Misa
(74) *Attorney, Agent, or Firm* — Duane C. Basch; Basch & Nickerson LLP

(57) ABSTRACT

A snow or material pushing device for plowing a surface including a moldboard with a scraper blade, and having side plates attached at either end. The side plates further include skid or wear shoes pivotally or rotationally affixed to the side plates to remain in full contact with the surface, thereby reducing the need to adjust and replace the scraper blade and wear shoes.

19 Claims, 8 Drawing Sheets

(56) References Cited

U.S. PATENT DOCUMENTS

| | | | | |
|---|---|---|---|---|
| 5,121,562 | A | 6/1992 | Feller | |
| 5,185,946 | A | 2/1993 | Farrell | |
| 5,285,588 | A * | 2/1994 | Niemela et al. | 37/234 |
| 5,307,570 | A * | 5/1994 | Brown | 37/439 |
| 5,344,254 | A * | 9/1994 | Sartain | 404/104 |
| 5,410,824 | A * | 5/1995 | Pedersen | 37/242 |
| 5,438,770 | A * | 8/1995 | Miller | 37/227 |
| 5,724,755 | A | 3/1998 | Weagley | |
| 5,813,152 | A * | 9/1998 | Weight | 37/447 |
| 5,894,688 | A | 4/1999 | Struck et al. | |
| 6,112,438 | A | 9/2000 | Weagley | |
| 6,151,808 | A * | 11/2000 | Curtis | 37/234 |
| 6,425,196 | B1 | 7/2002 | Weagley et al. | |
| 6,470,604 | B1 | 10/2002 | Foster et al. | |
| 6,508,018 | B1 * | 1/2003 | O'Brien | 37/223 |
| 6,560,904 | B2 | 5/2003 | Guggino | |
| 6,612,050 | B2 | 9/2003 | Takeuchi | |
| 6,751,894 | B2 * | 6/2004 | Verseef | 37/266 |
| 6,845,576 | B2 * | 1/2005 | Vennard et al. | 37/266 |
| 7,089,692 | B2 | 8/2006 | Strait | |
| 7,100,314 | B1 | 9/2006 | Jensen | |
| 7,137,214 | B2 * | 11/2006 | Hoerle et al. | 37/242 |
| 7,555,853 | B2 | 7/2009 | Paonessa | |
| 7,654,016 | B2 | 2/2010 | Stephan | |
| 7,658,022 | B2 * | 2/2010 | Strait | 37/232 |
| 7,779,563 | B2 * | 8/2010 | Mills | 37/274 |
| 7,975,409 | B2 | 7/2011 | Paonessa | |
| D657,395 | S * | 4/2012 | Bauer et al. | D15/11 |
| 8,191,288 | B2 | 6/2012 | Weagley et al. | |
| 8,584,383 | B1 * | 11/2013 | Morse et al. | 37/244 |
| D705,272 | S * | 5/2014 | Cmich et al. | D15/11 |
| 8,887,413 | B2 * | 11/2014 | Miller | 37/281 |
| 2005/0126051 | A1 | 6/2005 | Fatemi | |
| 2006/0150444 | A1 * | 7/2006 | Friberg et al. | 37/244 |
| 2006/0218822 | A1 | 10/2006 | Hosmer | |
| 2008/0052929 | A1 * | 3/2008 | Paonessa | 33/333 |
| 2011/0314707 | A1 * | 12/2011 | Raftery | 37/224 |
| 2011/0315465 | A1 * | 12/2011 | Henry | 180/182 |
| 2012/0017473 | A1 | 1/2012 | Paonessa | |
| 2012/0074662 | A1 * | 3/2012 | Sayre | 280/28.17 |
| 2015/0068074 | A1 * | 3/2015 | Mast et al. | 37/197 |

OTHER PUBLICATIONS

Daniels Box Plow; A Box Plow with a Steel Tip Edge; www.danielsplows.com; 1advertising page; Great Lakes & Northeast Blg Truck & Equipment Traders—Apr. 27, 2001; Issue #16.

Degelman 40 years Brochure 1962-2002; 24 pages; Degelman product brochure 2002; Degelman Industries Ltd; 272 Industrial Dr. Regina, SAS, CA S4P 3B1; degelman.com.

Degelman Dozer Blades brochure; 4 pages;Degelman Industries Ltd., PO Box 830, Regina, SAS, CA; Earliest publication date unknown, available approx. Jan. 1, 1980.

First Place Pusher brochure 2 pages; May 2002; First Place Pusher, Route 68, Rutland MA 01543.

Ledex Avalanche Bury the Competition Advertisement 5 pages; 1998; Ledex Industries Corp, 307 Humberline Drive, Toronto, Ontario, CA.

Monroe Snow and Ice Control Brochure; 3 pages; Monroe Snow Removal Systems for Construction Machinery, 1051 W. 7th St., Monroe, WI 53566.

Pro-Tech Fold Out Pusher FOP brochure 1 page c. 2001; Pro-Tech, 711 West Ave., Rochester, NY.

Pro-Tech Snopushers Brochure; 4 pages.

RCS SnoPro color advertisement, 1 page; RCS Manufacturing and Development, 1029 Lyell Ave., Rochester, NY.

Tenco Snowblower TC-272 brochure specification sheet; 2 pages; c. 1994; Tenco Machinery (CDN) Ltd; C.P. 60, St-Valerien-de-Milton, Quebec, CA J0h 2B0;telephone 450-549-2411; website tenco.ca.

Tenco TC-272 Snowblower Manual 14292; operators parts & maintenance manual & parts catalog; 1999; Les Machineries Tenco (CDN) ; 1318, Principale, St-Valerien-de-milton, Quebue, CA J0h 2B0; website tenco.ca; 70 pages.

U.S. Appl. No. 13/136,340—unofficial file history as of Mar. 25, 2013 for U.S. Appl. No. 13/136,340, filed Jul. 29, 2011, published Jan. 26, 2012, as US-2012-0017473-A1; Inventor: Gino Paonessa.

* cited by examiner

SURFACE COMPLIANT FRONT-PIVOTING WEAR SHOES FOR SNOW PUSHER

A snow pushing apparatus is disclosed that includes skid or wear plates pivotally connected near a front edge of the pusher side plate so that the operator may control the force applied to the pusher scraping edge and assure contact is made to the surface while moving snow or other material.

BACKGROUND AND SUMMARY

Snow pushers are well known apparatus for clearing snow and other materials or debris from surfaces such as roadways, driveways, parking lots, runways and other areas, as described for example in U.S. Pat. Nos. 5,724,755 and 6,112,438 to Weagley, hereby incorporated by reference in their entirety. Snow pushers are typically engaged with a bucket or quick coupling mechanism on a vehicle such as a front end loader, backhoe, skid steer loader, etc., and are pushed along to remove snow. Side plates are attached on the opposite ends of a moldboard for increasing the volume of snow that can be moved by the snow pusher. More specifically, the side plates serve the function of containing the snow in front of the moldboard and between the side plates, such that the snow continues to be gathered by the snow pusher.

One aspect of the disclosed embodiments provides for a pivoting wear shoe that remains in total contact with the surface, independent of the pusher angle or downward force applied to the scraping edge. Accordingly, it is an object of the disclosed embodiments to provide a wear shoe having an axis of rotation adjacent or near the front or distal end of the wear shoe and associated side plate in combination with a limiting slot at the opposite or proximal end. In order to control the range of the pivot, the wear shoe and/or side plate may include a slot and pin, bolt or bushing passing through the slot to provide limited motion based upon the length of the slot.

A skid plate or wear shoe on a conventional material pushing machine is securely affixed to the bottom edge of the side plate and is, by design, subjected to extensive abrasion resulting from the contact between the wear shoe and the roadbed or other surface over which the pusher travels. This wearing action is exacerbated when the snow pusher wear shoes are not positioned parallel to the surface, whereby only a portion of the available wear shoe surface is in direct contact with the roadbed. As a result the friction is increased over a small area causing uneven wear, and the lower surface plate of the wear shoe prematurely wears through and must be replaced more often. This is an expensive proposition because of down time of the machine and the cost expended in manpower and materials to replace the wear shoe.

A snow pusher further includes a scraper blade that is removably attached along the entire length of the bottom portion of the moldboard. The attributes of the scraper are threefold: (i) the material is selected based upon anticipated needs (e.g., soft edge such as rubber or polymer for light snow; hard steel edge on polymer backing for hard-packed snow and ice)moldboard, and becomes a sacrificial member that wears during use, as is the wear shoe, that protects the moldboard from wear; (ii) including a compliant material allows for the scraping edge to yield when a protrusion from the surface is encountered; and (iii) given various angles and downward pressure the scraping is better able to accommodate various snow conditions, ranging from ice to slush.

Typically, the wear shoes of a pusher control the distance separating the moldboard from the surface and thereby the amount of contact force between a scraping edge mounted on the bottom of the moldboard and the surface being plowed.

However, given that the wear shoe and scraping edge are not readily adjustable on most pushers, as the scraping edge wears the ability to remove the snow or other materials down to the surface becomes more difficult. Currently either the scraping edge needs to be periodically adjusted downward to account for wear or be removed and then reattached in an alternate mounting orientation to re-establish the preferred amount of contact between the edge and the surface being cleaned. As will be further described below, the disclosed embodiments reduce or eliminate the need for periodic adjustment. Hence, one aspect of the disclosed embodiments is the ability of the front-pivoting wear shoe to permit a broad range of use and force to be applied to the scraping edge without the need to continually adjust the attachment position of the scraping edge relative to the bottom of the moldboard. For example, in one embodiment, a 4-5 inch range of motion is contemplated, which provides for an extended period of use without adjustment or replacement of the scraping edge.

As can now be appreciated, a significant and reoccurring problem with pushers having fixed wear shoes is that the operator often tilts the bucket upward in order to place the scraping edge of the pusher into greater contact with the surface being plowed (e.g., to increase down-pressure as the scraping edge wears and/or to scrape compacted snow from the surface). In doing so the wear shoe is no longer held parallel to the surface and uneven wear is encountered on the rear of the wear shoe. Moreover, the fixed mounting of the wear shoes prevents the application of varying downward pressure on the scraping blade. Therefore, it is believed to be desirable to provide a wear shoe that is pivotally attached to the side plate of the pusher, to allow the downward pressure applied to the moldboard and scraping edge to be varied without having to tilt the pusher or lift the front of the wear show off the surface.

One object of the disclosed embodiments to ensure that the wear shoe is compliant when a downward force is applied to the moldboard and scraping edge for completely clearing down to the surface.

Another object of the disclosed embodiments is to maximize the useful life of the wear shoes by promoting uniform contact with the surface.

Other objects, features and advantages will be evident from a reading of the following description and by reference to the accompanying drawings.

Disclosed in embodiments herein is a material pushing apparatus, comprising: an upstanding blade including an upper longitudinal edge, a lower longitudinal edge, a first vertical edge and a second vertical edge; a first vertical side plate extending forward from the first vertical edge of the blade; a second vertical side plate extending forward from the second vertical edge of the blade; a scraping edge attached along the lower longitudinal edge of the blade; and at least one wear shoe pivotally affixed to each of the first and second vertical side plates adjacent a front edge thereof, said wear shoe having a locus for the axis of rotation at a point distal from the cutting edge.

Further disclosed in embodiments herein is a snow pusher for plowing a surface, comprising: an upstanding blade having a first longitudinal edge and a second longitudinal edge including a first vertical edge and a second vertical edge; a first vertical side plate extending forwardly, at a right angle from the first vertical edge, of the blade; a second vertical side plate extending forwardly from the second vertical edge, of the blade; a scraper member attached to the first longitudinal edge of the blade, said scraper member being of a material that will be abraded by the surface; at least one wear shoe rotationally affixed to each of the first and second vertical side plates having a locus for the axis of rotation at a distal point from the cutting edge; and a vehicle, operatively attached to the snow pusher, said vehicle applying force to both drive the pusher forward and to maintain the scraping edge in contact with the surface.

Figure 1:
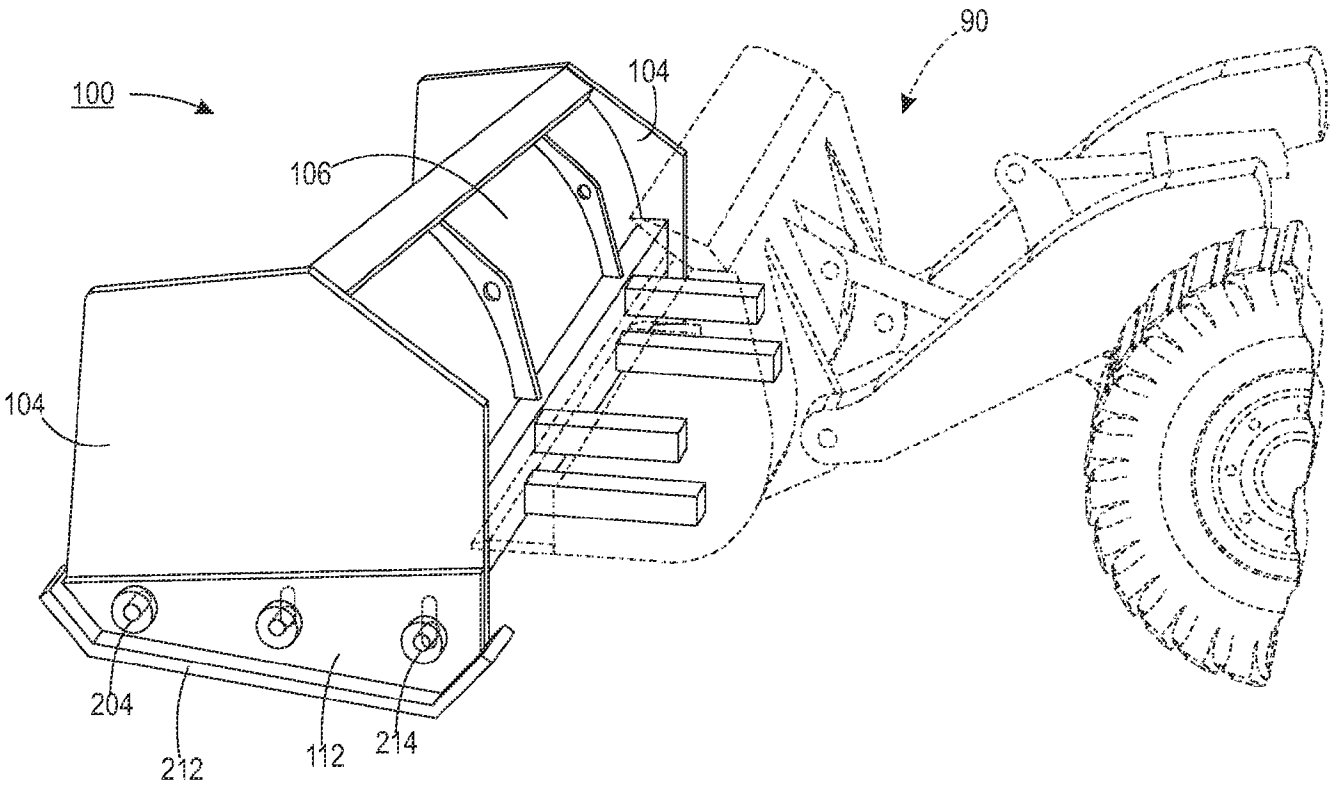
FIG. 1 is a rear side perspective view of the a pusher in accordance with a disclosed embodiment.

The various embodiments described herein are not intended to limit the disclosure to those described. On the contrary, the intent is to cover all alternatives, modifications, and equivalents as may be included within the spirit and scope of the various embodiments and equivalents set forth. For a general understanding, reference is made to the drawings. In the drawings, like references have been used throughout to designate identical or similar elements. It is also noted that the drawings may not have been drawn to scale and that certain regions may have been purposely drawn disproportionately so that the features and aspects could be properly depicted.

DETAILED DESCRIPTION

As used herein the term "pusher" includes various styles of containment plows that generally include a moldboard along with one or more side plates extending forward from each end of the moldboard to assure that the material being gathered and pushed along (e.g., snow, litter, sludge, mulch, etc.) remains contained in front of the pusher that is attached to loaders, backhoes, skid steers and the like.

Figure 2:
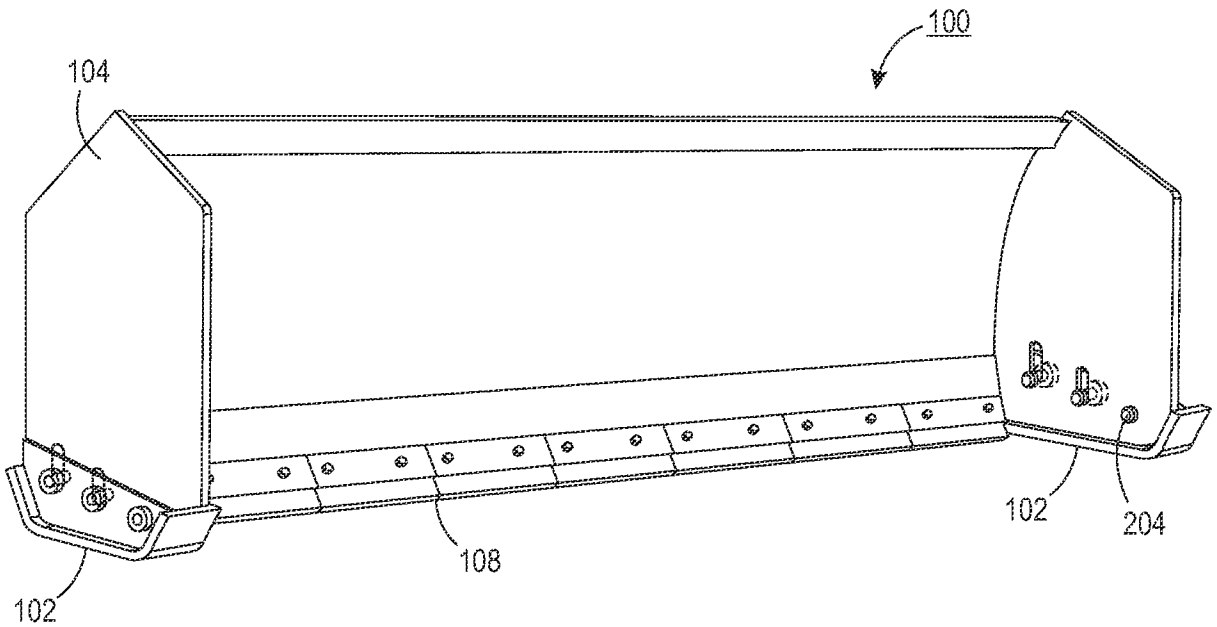
FIG. 2 is ac front perspective view of an exemplary snow pusher showing elongated slots and pivots.

Referring now to the drawings an exemplary snow or material pusher 100 is represented in FIGS. 1 and 2. As illustrated, the pusher includes a moldboard or blade 106, side plates 104 and wear shoe 102. The pusher 100 is pushed and moved under the control and force of a vehicle 90, such as a loader, backhoe, etc. as mentioned above. As FIG. 2 illustrates, pusher 100 also include a scraping edge or blade 108 and its relationship to wear shoes 102. As illustrated, scraping edge 108 includes a rubber or polymer flexible member 110A (which may be reversible if used as the scraping edge) along with a resilient scraper 110D (e.g., steel), attached to the bottom of the moldboard using a backing plate 1108 and bolts 110C. Furthermore, each wear shoe 102 is pivotally attached adjacent the distal or outer bottom corner of side plates 104 using a pivot attachment such as a bolt or pin 204. Although various configurations may dictate a change in the position of the pivot, the intent of the disclosed embodiments is to provide a pivot that improves the responsiveness of the moldboard and cutting edge to downward pressure applied from the driving vehicle. Thus, the location of the front pivot should be adjacent the leading edge of the side plate, within 3-10 inches of the lead edge of wear shoe 102, and preferably in the range of 5-7 inches to maximize the ability to control the scraping edge pressure. The wear shoe 102 also has a web 112 through which the pivot is attached using bolt or pin 204. As illustrated in several embodiments discussed, the pivot hole and/or other slots that control the motion of the wear shoe relative to the side plate may have reinforced profiles (e.g., bosses) around them in order to increase resistance to wear or damage. It is also contemplated that the bolts depicted as passing through the holes and apertures may include bushings or the like to improve the longevity and functionality of the front-pivot wear shoe.

Figure 3:
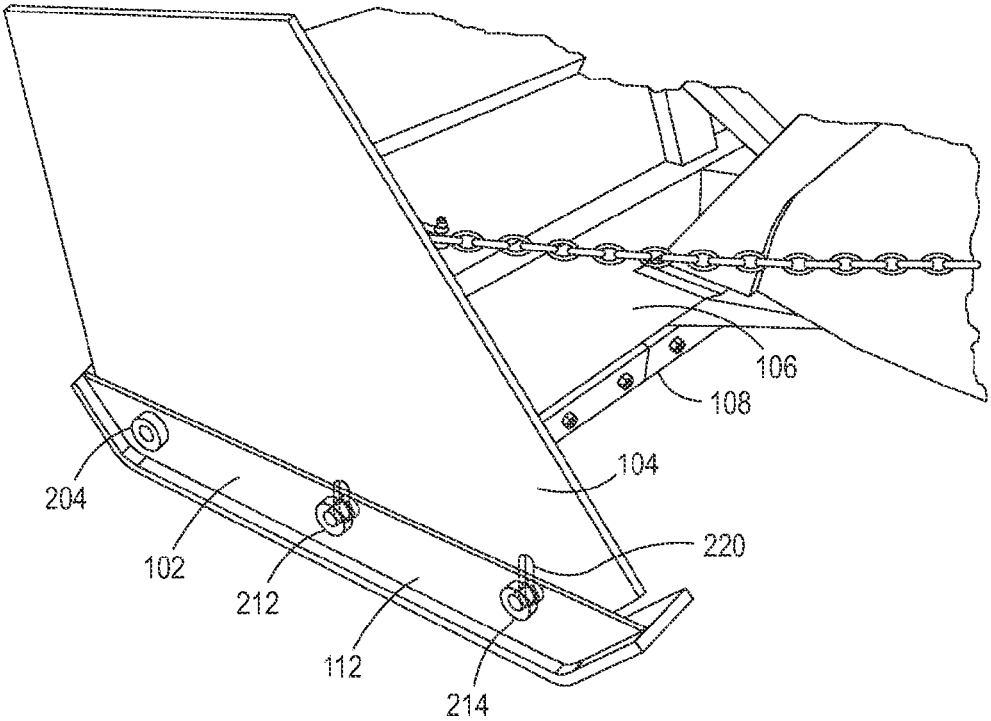
FIG. 3 is a side perspective view of a left side wear shoe and lower portion of a side plate for another snow pusher embodiment having an extended wear shoe.
Figure 4:
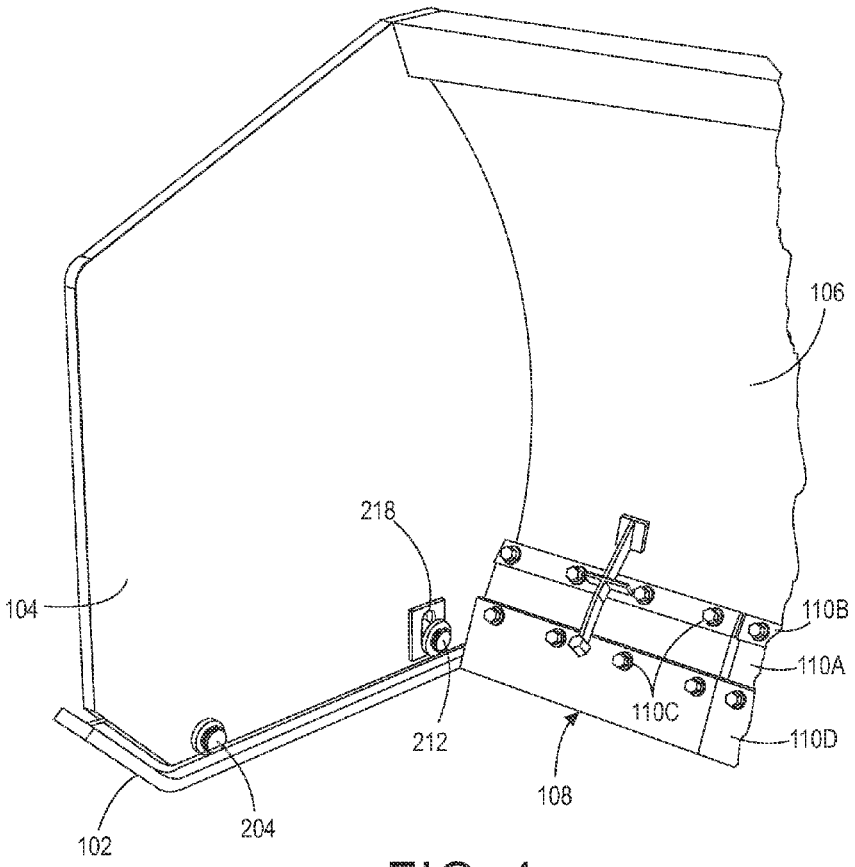
FIGS. 4 and 5 are left inside perspective views of a pivoting wear shoe embodiment, showing both actual and cut-away views, respectively.

Also referring to FIGS. 3 and 4, depicted therein is a wear shoe 102 for an alternative show pusher embodiment having an extended wear shoe that extends significantly beyond the back of the moldboard 106 and scraping edge 108. Once again the wear shoe is attached pivotally near the front edge of the wear shoe using a bolt or pin 204 that passes through the side plate 104. As illustrated, the web 112 also includes at least two additional bolts holes and bolts or pins 212 and 214 pass through the holes and also through slots or apertures (e.g., 218) in the side plate as described more specifically below. In use, the pivot at bolt 204 and the slots in the side plate where bolts 212 and 214 pass through, allow the operator to control the relative position of the rear of the wear shoe with regard to the side plate, and thereby adjust the downward pressure or force being applied along the scraping edge 108. Although FIG. 4 shows an ice-scraping edge 108 that includes a metal cutting edge on the bottom and a biasing mechanism 109 as described for example in published U.S. Patent Application 2007/0107272 A1 (Ser. No. 11/556,116), for a SNOW PUSHER FOR ICE AND SNOW REMOVAL, filed Nov. 2, 2006 by M. Weagley et al., hereby incorporated by reference in its entirety, and it will be appreciated that other edge materials and configurations may also be employed in combination with the disclosed front-pivoting wear shoe.

Figure 5:
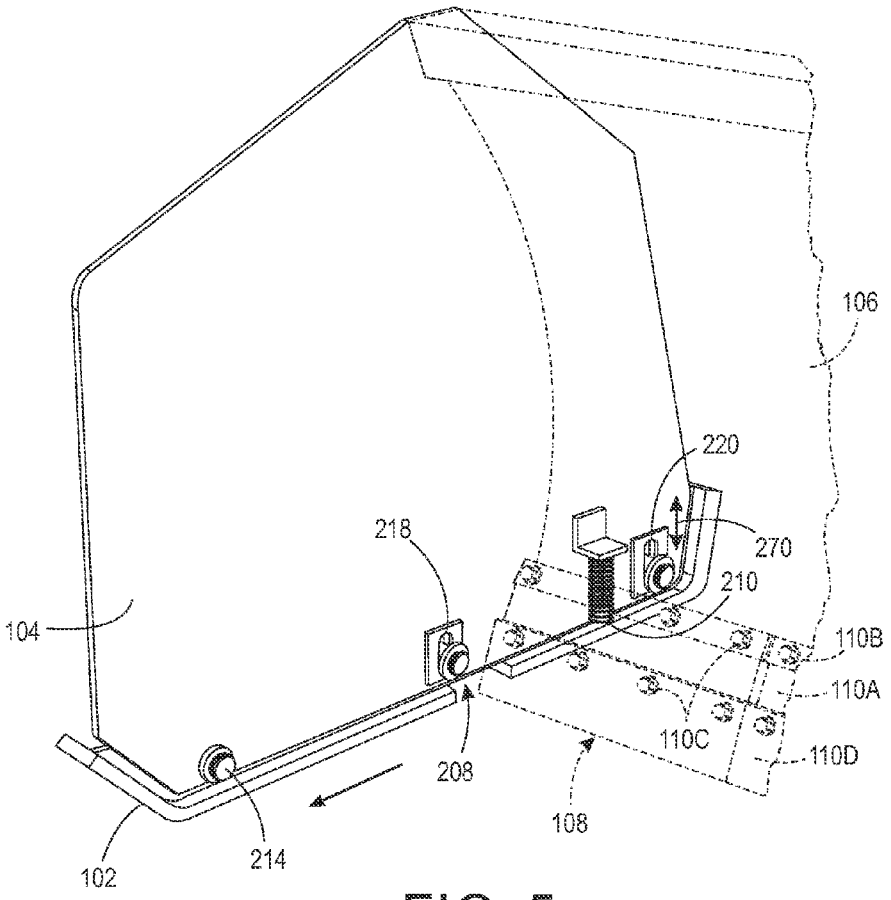
Figure 6:
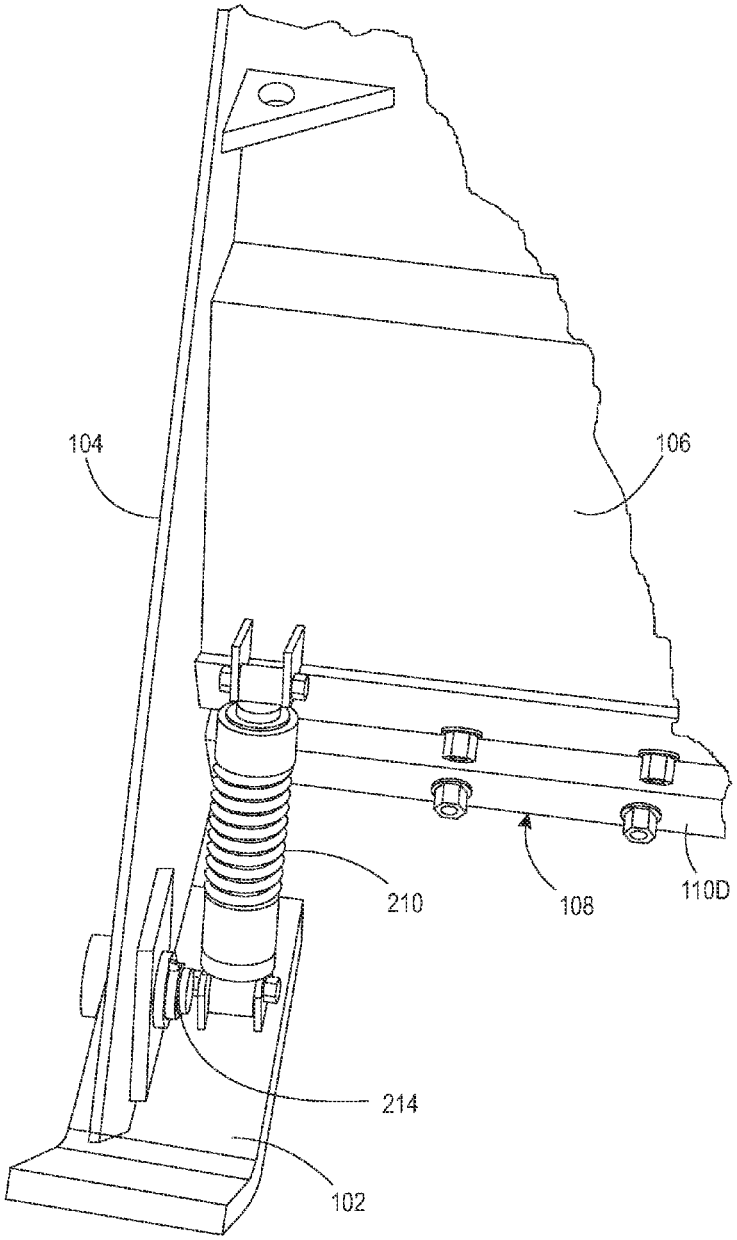
FIG. 6 is a perspective view of the rear of an embodiment employing a compression spring to provide a resilient mount for the rear of the wear shoe.
Figure 7:
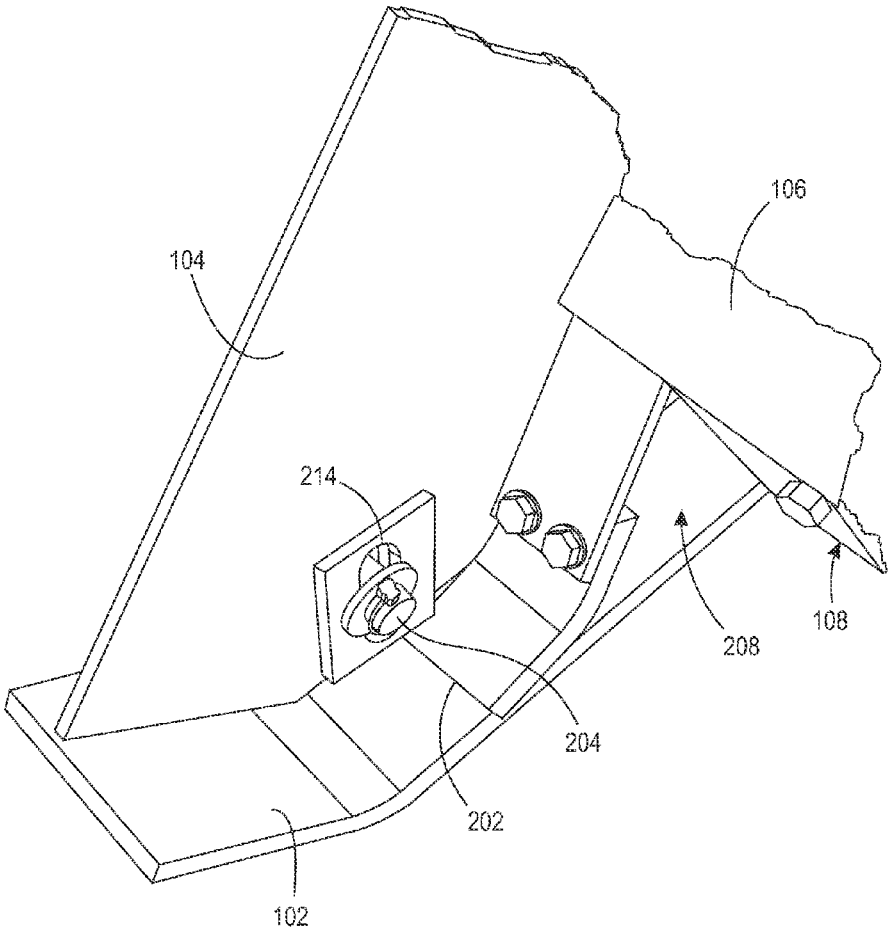
FIG. 7 is an alternative embodiment of FIG. 6, showing a leaf-type spring or member to provide the resilient mount.

Turning next to FIGS. 5-7, depicted therein are further alternative embodiments for the front-pivoting wear shoe, where a resilient member or spring has been employed to provide a biasing force between the wear shoe and the moldboard or side plate. Referring to FIGS. 5 and 6, initially, wear shoe 102 includes a generally horizontal flat plate and inclined front and rear ramp surfaces for sliding contact on a surface. In one embodiment, wear shoe 102 is constructed from a hard, wear resilient material and a perpendicular web or gusset 112 that longitudinally traverses the length of wear shoe. The wear shoe 102 is pivotally attached near the front bottom edge of side plate 104 (similar configuration on each side plate although the opposite side plate is not illustrated) to allow for 5-25 degrees and preferably up to about 15 degrees of arcuate motion for wear shoe 102 relative to the side plate 104 as represented by arrow 270. Alignment of the wear shoe 102, relative to side plate 104, is maintained by one or more arcuate apertures, 218 and 220, that are illustrated in side plate 104, although it will be appreciated that such apertures may be provided in gussets 112. Each aperture includes a captive pin or bolt 212 or 214 passing through and connecting the web and side plate in a sliding manner to guide the rear end of wear shoe 102 through an arcuate path. In the alternative noted above, the positions of the arcuate apertures 212 and 214 may be changed, with the arcuate apertures being formed within web 112.

Although it is possible to use any number of coil spring members 210 to provide the biasing force between the wear shoe and side plate or moldboard, in the embodiment of FIG.

6, the coil spring is further coupled with a dampening member, for example a spring and shock absorber combination as commonly used in the automotive industry. As will be appreciated, a dampening member combined with a coil spring will reduce the likelihood of unwanted oscillation of the wear shoe, and will maintain more consistent contact and force between the scraping edge and the surface being plowed. Continuing with FIGS. 5 and 6, wear shoe 102 enables the application of a downward normal. Compression spring 210, having a distal end secured to side plate 104 and/or moldboard 106, and a proximal end attached to the horizontal plate of wear shoe 102, provides the reactive force to maintain uniform contact of wear shoe 102 to the surface. It should be understood that the required force can also be derived from alternative means such as the resilient member 210 as illustrated in FIG. 6. In FIG. 7, a resilient member such as a leaf spring 202 is attached to the side plate 104 or moldboard 106 on one end and a free end is in contact with the horizontal plate of wear shoe 102. The material of leaf spring 202 is one having a high resilience to corrosion as well as an appropriate modulus of elasticity in relationship to the force necessary to support the weight of pusher 100. While only a passive reactive force has been shown in an alternative embodiment it is possible to integrate a dynamic reactive force through the use of pneumatic or hydraulic cylinders, whereby the relative position between the wear shoes and side plates would be primarily controlled by an adjustment of the pneumatic or hydraulic pressure in the respective cylinders.

Lastly, as best seen in FIGS. 5 and 7, the horizontal plate of wear shoe 102 is located in proximity to the scraping edge, and for the most part encroaches into the space occupied by the edge. Accordingly, in one embodiment, a clearance cut out 208 may be included in the profile of the wear shoe plate to eliminate the possibility of interference as the scraper blade 108 spans the entire width of the moldboard. As seen in FIG. 7, having the scraper blade 108 positioned within cutout 208 minimizes the potential for the trailing edge of cutout 208 to accumulate snow by scraping the surface.

As described relative to the various embodiments and alternatives above, the use of a front-pivoting wear shoe and biasing spring allows for various angles between the side plate and wear shoe resulting in control of the pressure to be applied to scraper blade 108 while wear shoe 102 remains in contact with the surface. This is accomplished by having the axis of rotation (i.e. pinion 204) located at a forward point from the scraper blade 108. As a result the operator is able to compensate for various snow and ice conditions by adjusting the position of the bucket to vary the scraping angle and downward force or pressure of the scraping edge 108. Previously the surface clearance of snow pusher 100 as well as the force applied directly onto scraper blade 108 was pre-determined by the fixed position of the wear shoes and scraping edge.

Figure 8:
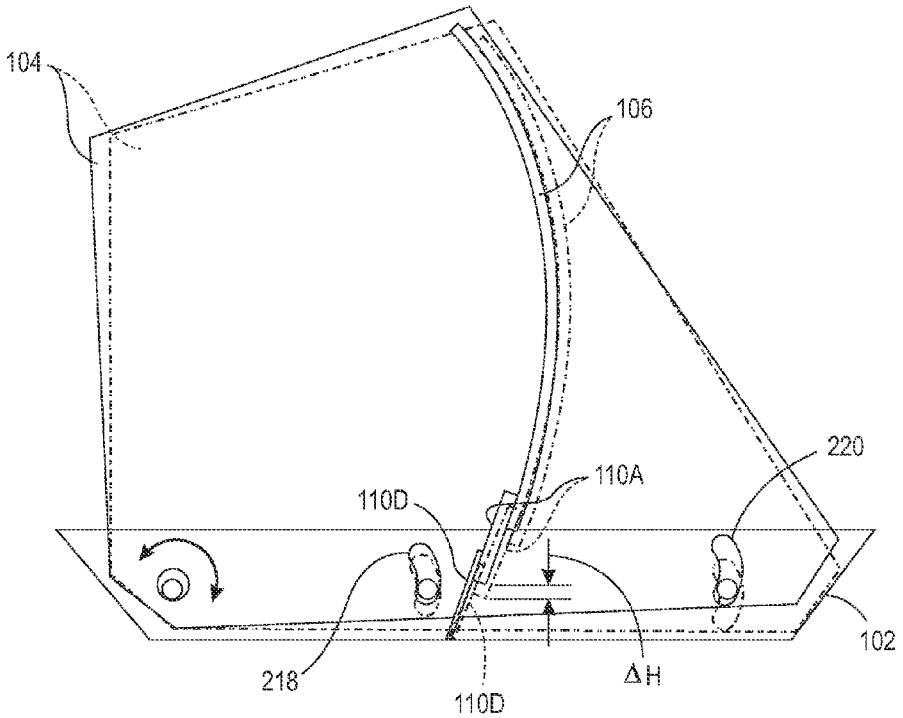
FIG. 8 is an inner side view of an embodiment showing relative positions between the moldboard and its components and the front-pivoting wear shoe.

Referring next to FIG. 8, depicted therein is an inner side view of one of the disclosed embodiments showing the relative position of the moldboard or blade with a resilient scraping edge 110D that is new (solid line) and worn (dashed line). As illustrated, the abrasive wear of the resilient scraping edge 110D may be compensated for by the rotational position of the moldboard or blade 106 and side plate 104 relative to the wear shoe 102. As illustrated, a change in height of AH may be seen, thus allowing approximately the same amount of wear on the edge 110D before the edge needs to be replaced or adjusted. In one embodiment, the edge 110D extends below the bottom of the flexible member 110A by up to about 4-5 inches, and as a result the range of movement enabled by the middle and rear arcuate slots 218 and 220 should accommodate up to that amount of change in the position of the scraping edge. Furthermore, the range of motion permitted by slots 218 and 220 is equal to or slightly less than the distance that the scraping edge 110D extends below the flexible member 110A so that a change of AH uses up the scraping edge but does not result in abrasive wear of the flexible member 110A.

In summary, the disclosed embodiments provide for control over the position, angle and force applied to a scraper blade that is attached to the bottom of a moldboard of a pusher, thereby allowing an operator to "adjust" the pusher for various surface and weather conditions. Accordingly, the rigid wear shoe mounting structure has been modified and through the use of pivots and pins in slots control of the position and force has been returned to the operator.

It will be appreciated that various aspect of the aforedescribed improvements and modifications may be applied or adapted to operate in conjunction with or on other types of pushers, including but not limited to, fold-out pushers and other types of snow plows and blades. It will be further appreciated that various characteristics, features and alternatives of the above-disclosed snow pusher may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A material pushing apparatus, comprising:

an upstanding blade including an upper longitudinal edge, a lower longitudinal edge, a first vertical edge and a second vertical edge;

a first vertical side plate extending forward from the first vertical edge of the blade;

a second vertical side plate extending forward from the second vertical edge of the blade;

a scraping edge attached along the lower longitudinal edge of the blade; and at least one wear shoe freely pivotally affixed to each of the first and second vertical side plates adjacent a front edge of the respective side plate, said wear shoe having a locus for an axis of rotation for the at least one wear shoe at a point along the front of the wear shoe, wherein a biasing force is applied between the material pushing apparatus and the wear shoe.

2. The material pushing apparatus according to claim 1, wherein said biasing force is applied along the rear of the wear shoe.

3. The material pushing apparatus according to claim 2, wherein said biasing force is derived from a spring.

4. The material pushing apparatus according to claim 2, wherein said biasing force is derived from a leaf spring.

5. The material pushing apparatus according to claim 2, wherein said biasing force is dampened.

6. The material pushing apparatus according to claim 1, wherein said side plates each include an arcuate aperture, in close proximity to the scraping edge, having a pin interconnecting said wear shoe and said side plate within the aperture.

7. The material pushing apparatus according to claim 1, wherein said wear shoes each include an arcuate aperture, in close proximity to the scraping edge, and each having a pin extending through said aperture to slidably interconnect the wear shoe to the respective side plate.

8. The material pushing apparatus according to claim 1, wherein the scraping edge includes a flexible member attached to the lower longitudinal edge of the blade and a metal portion attached to and extending from the flexible member, and where rotational position of the blade relative to the wear shoe such that the scraping edge is in contact with a surface to be cleaned, yet the flexible member does not come into contact with the surface.

9. The material pushing apparatus according to claim 1, wherein said side plates each include an arcuate aperture, behind the scraping edge, having a pin interconnecting said wear shoe and said side plate within the aperture.

10. The material pushing apparatus according to claim 1, wherein said wear shoes each include an arcuate aperture, behind the scraping edge, and each having a pin extending through said aperture to slidably interconnect the wear shoe to the respective side plate.

11. A snow pusher for plowing a surface, comprising:

an upstanding blade having a first longitudinal edge and a second longitudinal edge including a first vertical edge and a second vertical edge;

a first vertical side plate extending forwardly, at a right angle from the first vertical edge, of the blade;

a second vertical side plate extending forwardly from the second vertical edge, of the blade;

a scraper member attached to the first longitudinal edge of the blade, said scraper member being of a material that will be abraded by the surface;

at least one wear shoe freely rotationally affixed to each of the first and second vertical side plates, said wear shoe having a locus for an axis of rotation at a point along the front of the wear shoe, wherein a biasing force is applied between the snow pusher and the wear shoe; and a vehicle, operatively attached to the snow pusher, said vehicle applying force to both drive the pusher forward and to maintain the scraper member in contact with the surface.

12. The snow pusher according to claim 11, wherein said biasing force is applied along the rear end of the wear shoe.

13. The snow pusher according to claim 12, wherein said biasing force is derived from a compression spring.

14. The snow pusher according to claim 12, wherein said biasing force is derived from a leaf spring.

15. The snow pusher according to claim 12, wherein said biasing force is derived from a hydraulic cylinder.

16. The snow pusher according to claim 12, wherein said biasing force is derived from a pneumatic cylinder.

17. The snow pusher according to claim 12, wherein a relative relationship between the scraper member and the wear shoe is adjustable to enable the scraper member to remain in contact with the surface as the scraper member is abraded.

18. The snow pusher according to claim 11, wherein said side plates each include an arcuate aperture, in close proximity to the scraper member, and each having a pin extending through said aperture to slidably interconnect the wear shoe to the respective side plate.

19. The snow pusher according to claim 11, wherein said wear shoes each include an arcuate aperture, in close proximity to the scraper member, and each having a pin extending through said aperture to slidably interconnect the wear shoe to the respective side plate.

* * * * *